US007463198B2

(12) United States Patent
Deaett et al.

(10) Patent No.: US 7,463,198 B2
(45) Date of Patent: Dec. 9, 2008

(54) NON-WOVEN TEXTILE MICROWAVE ANTENNAS AND COMPONENTS

(75) Inventors: Michael A. Deaett, North Kingstown, RI (US); William H. Weedon, III, Warwick, RI (US); Behnam Pourdeyhimi, CAry, NC (US)

(73) Assignee: Applied Radar Inc., North Kingstown, RI (US)

( * ) Notice: Subject to any disclaimer, the term of this patent is extended or adjusted under 35 U.S.C. 154(b) by 0 days.

(21) Appl. No.: 11/305,677

(22) Filed: Dec. 16, 2005

(65) Prior Publication Data

US 2007/0139275 A1 Jun. 21, 2007

(51) Int. Cl.
*H01Q 1/38* (2006.01)

(52) U.S. Cl. ..... 343/700 MS; 343/846; 343/897

(58) Field of Classification Search ..... 343/700 MS, 343/846, 897

See application file for complete search history.

(56) References Cited

U.S. PATENT DOCUMENTS 4,364,050 A * 12/1982 Lopez ..... 343/700 MS
5,872,542 A 2/1999 Simons et al.
6,008,763 A * 12/1999 Nystrom et al. ..... 343/700 MS
7,058,362 B1 * 6/2006 Khorrami et al. ..... 455/66.1
2004/0239567 A1 * 12/2004 Van Der Poel ..... 343/700 MS
2005/0235482 A1 * 10/2005 Deaett et al. ..... 29/600
2006/0256023 A1 * 11/2006 Juang et al. ..... 343/718

* cited by examiner

*Primary Examiner*—Tho G Phan

(57) ABSTRACT

A method of constructing an antenna, filter, or similar structure comprising one or more planar electrically conductive radiating and/or receiving elements having conductive feedlines attached thereto and a planar around reference conductor spaced therefrom by a spacer layer, comprising the steps of: providing a planar dielectric fabric spacer layer; applying conductive material to a first side of said spacer layer, by an embroidery process employing conductive thread or yarn, to define said electrically conductive radiating and/or receiving elements having conductive feedlines attached thereto; providing a planar around reference conductor on the opposite side of said planar spacer layer in a position corresponding to the pattern of said electrically conductive radiating and/or receiving elements having conductive feedlines attached thereto; and providing a connection whereby said conductive feedlines attached to said electrically conductive radiating and/or receiving elements, and said planar around reference conductor, can each be connected to associated signal transmitting and/or receiving equipment.

5 Claims, 9 Drawing Sheets

NON-WOVEN TEXTILE MICROWAVE ANTENNAS AND COMPONENTS

TECHNICAL FIELD

The present invention relates to an antenna for receiving or transmitting electromagnetic energy at or above microwave frequencies from or to a free space. The present invention more particularly relates to micro-strip patch or slot antennas.

BACKGROUND OF THE INVENTION

Patch and stripline antennas that are currently on the market usually comprise a radiating patch made of conductive material usually copper with feed lines attached to a dielectric spacer usually composed of Teflon and a ground plane again made of electrically conductive material and again this is usually copper. The ground plane and the radiating patches are attached to a connector. The radiating patches and feedlines are usually formed after the electrically conductive material in bonded to the Teflon dielectric spacer. The shapes are formed by either grinding away or by etching away with acid the undesired material. The groundplane is bonded to the other side of the dielectric space.

A stripline antenna is a term to describe patch antenna radiators fed by means of a stripline feed network.

In this invention, an electrically conductive adhesive material such as Shield Ex™ is used along with corrugated or "dimpled" non-woven fabrics to produce an antenna that is both light weight and flexible. This patent will describe how to construct a non-woven patch antenna.

The noun "stripline" as used here is a contraction of the phrase "strip type transmission line, a transmission line formed by a conductor above or between extended conducting surfaces. A shielded strip-type transmission line denotes generally, a strip conductor between two groundplanes. The noun "groundplane" denotes a conducting or reflecting plane functioning to image a radiating structure.

SUMMARY OF THE INVENTION

The antennas described in this invention differ from other patch and stripline antennas in that they are made with non-woven fabrics. In the current state of the art, the spacer material is composed of PTFE, Teflon, foam, and in some cases glass. The Teflon spacers add weight to the antennas and are not flexible. Conversely, by using non-woven fabrics, antennas can be made that are light-weight, flexible and larger than conventional patch or stripline antennas Non-woven fabrics are broadly defined as sheet or web structures bonded together by entangling fiber or filaments (and by perforating films) mechanically, thermally or chemically. They are flat, porous sheets that are made directly from separate fibers or from molten plastic or plastic film. They are not made by weaving or knitting and do not require converting the fibers to yarn. Non-woven fabrics are engineered fabrics that may have a limited life, may be single-use fabric or may be a very durable fabric. By using non-woven fabrics as backing for the conductive parts of these antennas and as spacer materials, patch and stripline antennas can also incorporate an increased separation between the patch array and the ground plane, while remaining lightweight and inexpensive.

The subject of this invention results from the realization that while microwave patch and stripline antennas are limited by the weight and cost of the spacer material, face fabrics and other materials, the use of non-woven fabrics allows for larger antennas at significantly lighter weight and less cost.

The antenna of the present invention comprises a ground layer or groundplane, a feed element, an antenna layer, and a corrugated or "dimpled" dielectric substrate interposed between at least two of the layers. An electromagnetic field is produced between the ground layer and the antenna layer when the feed and ground layers are exposed to electromagnetic energy at frequencies from 400 megahertz to 100 gigahertz for transmission and when the antenna and ground layers are exposed to electromagnetic energy at microwave frequencies of 100 megahertz to 100 gigahertz for reception. The ground layer and antenna layers are made of a layer of non-woven textile fabric with an electrically conductive adhesive material such as Shield X to provide light weight and flexibility to the antenna. The spacer layer between the ground layer and the antenna layer is made of a corrugated or dimpled non-woven fabric that provides consistent insulated separation between the ground layer and the antenna layers while having the properties of being light weight, flexible, inexpensive and able to vary the spacing between the antenna plane and the ground plane.

BRIEF DESCRIPTION OF THE DRAWINGS

The forgoing and other features of the invention will become more apparent to one skilled in the art upon consideration of the following description of the invention and the accompanying drawings in which.

DETAILED DESCRIPTION OF THE INVENTION

Figure 1:
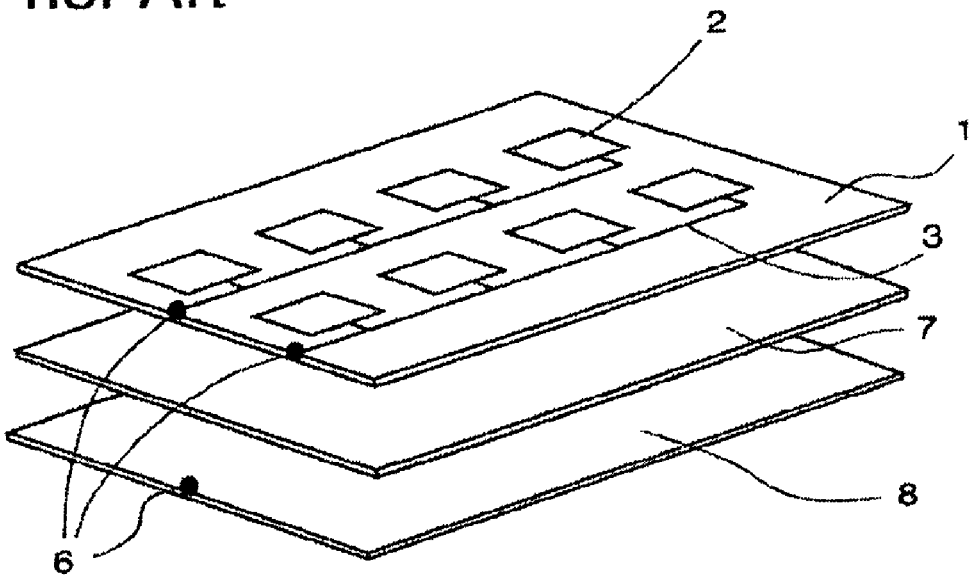
FIG. 1 Prior Art
FIG. 1 is a three dimensional diagram of a conventional three layer micro-strip laminated antenna.

FIG. 1 is a rendition of the prior art three layer micro-strip antenna commonly employed for transmitting and receiving microwave radiation. This antenna is comprised of a first conductive patterned face layer 1 comprising a set of radiating patch antennas 2 and a set of feed lines 3 that carry energy from a connector means 6 to said patch antennas. While this is depicted as three different pieces (1, 2, 3), in reality the radiating patch layer is composed of a layer of copper that is either milled or acid etched to the desired shaped antenna patches and feed lines. This antenna layer is bonded to a dielectric spacer layer 7, usually composed of Teflon, and bonded to a third layer, the ground plane 8. The conductive portions of this antenna are connected to a receiver or transmitter or transceiver by a connector means 6.

Figure 2:
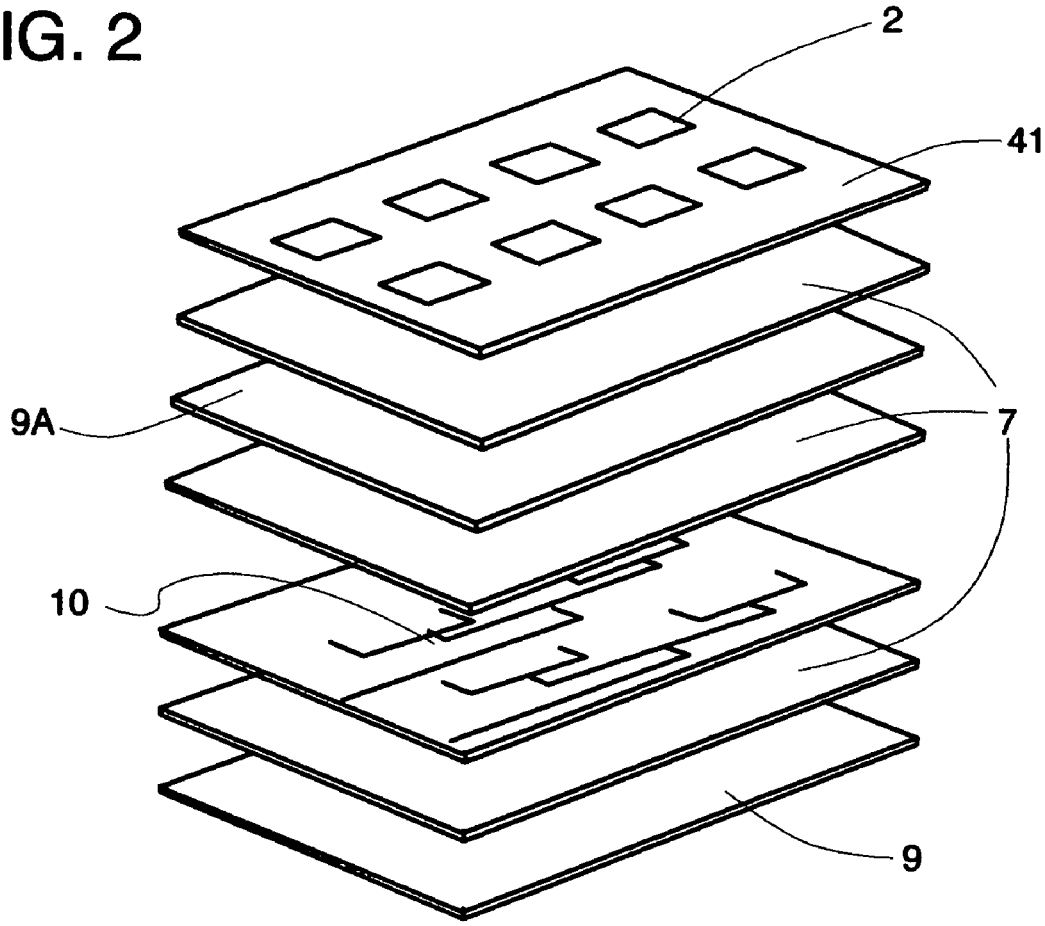
FIG. 2 is a three dimensional diagram of a multilayer strip-line laminated antenna.

FIG. 2 is a diagram of the current technology for a stripline antenna design which consists of a radiating layer 41 of antenna patches 2, dielectric spacer layer 7 a feed layer 10 that supplies current through the dielectric spacer and an aperturated ground plane 9A. A conventional ground plane 9 at the opposite end of the layers acts to contain the microwave energy. Not shown in this diagram are feed slots or apertures to connect the various radiating layers of the stripline antenna.

Figure 3:
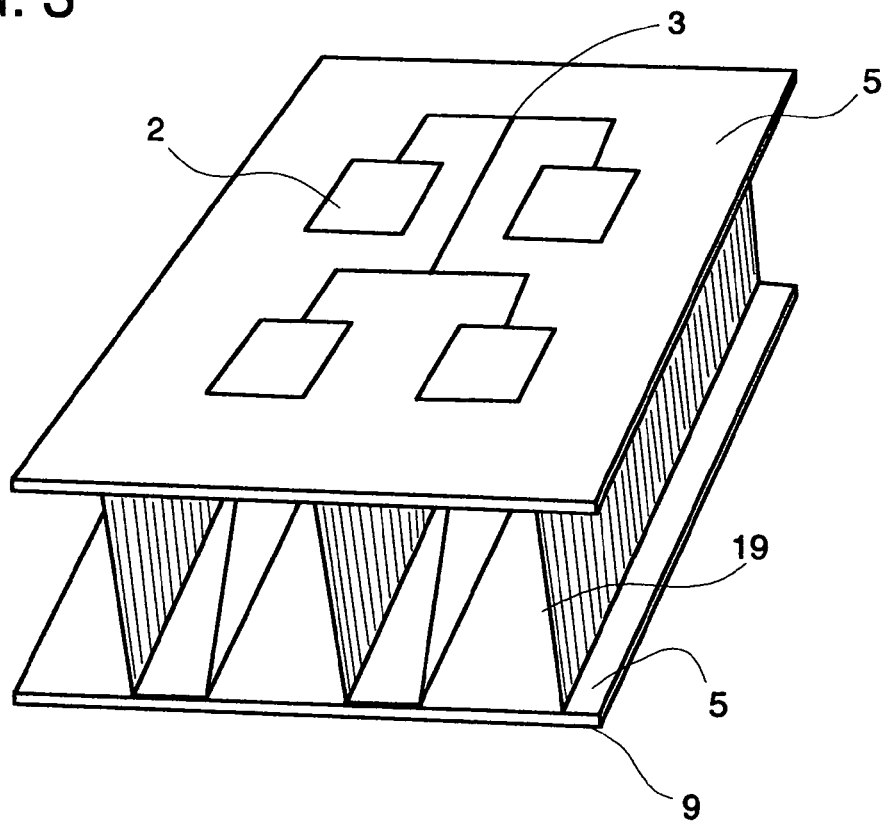
FIG. 3 is a three dimensional diagram of a micro-strip antenna showing construction from non-woven textiles and metallic fabric.

This detailed description will concern the construction of a three layer micro-strip antenna. FIG. 3 shows a means of constructing a three layer micro-strip antenna where a molded or folded non-woven fabric is incorporated as an interdigitated (corrugated), molded, non-woven spacer fabric 19. Here, the antenna patches 2 and feedlines3 are cut from a conductive fabric, ShieldX 151, 11, and attached to a retainer non-woven fabric 5. The non-woven dielectric spacer 7 in this three layer micro-strip antenna, is comprised of an interdigitated (corrugated), molded, non-woven spacer fabric 19 and the ground plane is constructed by bonding ShieldX 151, 11, to another retainer non-woven fabric 5.

Figure 4:
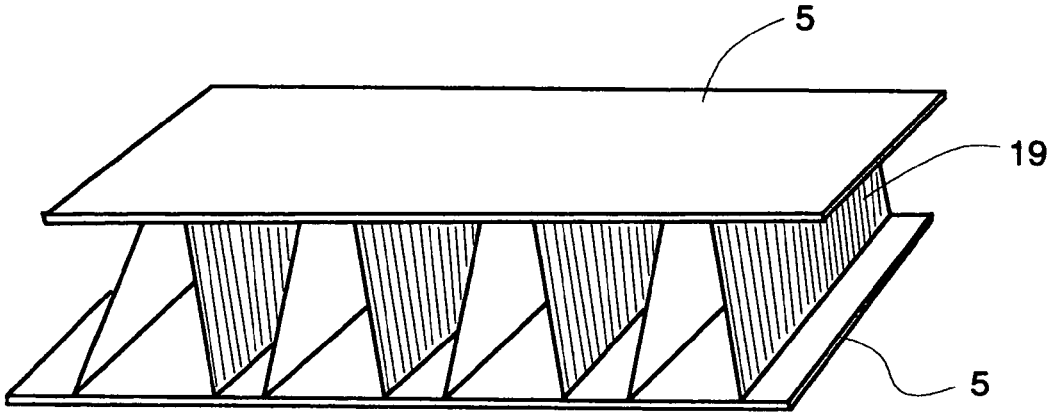
FIG. 4 is a diagram of a non-woven textile used as a spacer in constructing microwave antennas.

FIG. 4 is another view showing the spacer 7 composed of an interdigitated (corrugated), molded, non-woven spacer fabric 19 bonded between retainer non-woven fabric 5. This can provide greater distance between the antenna patches 2 and the ground plane 9.

Figure 5:
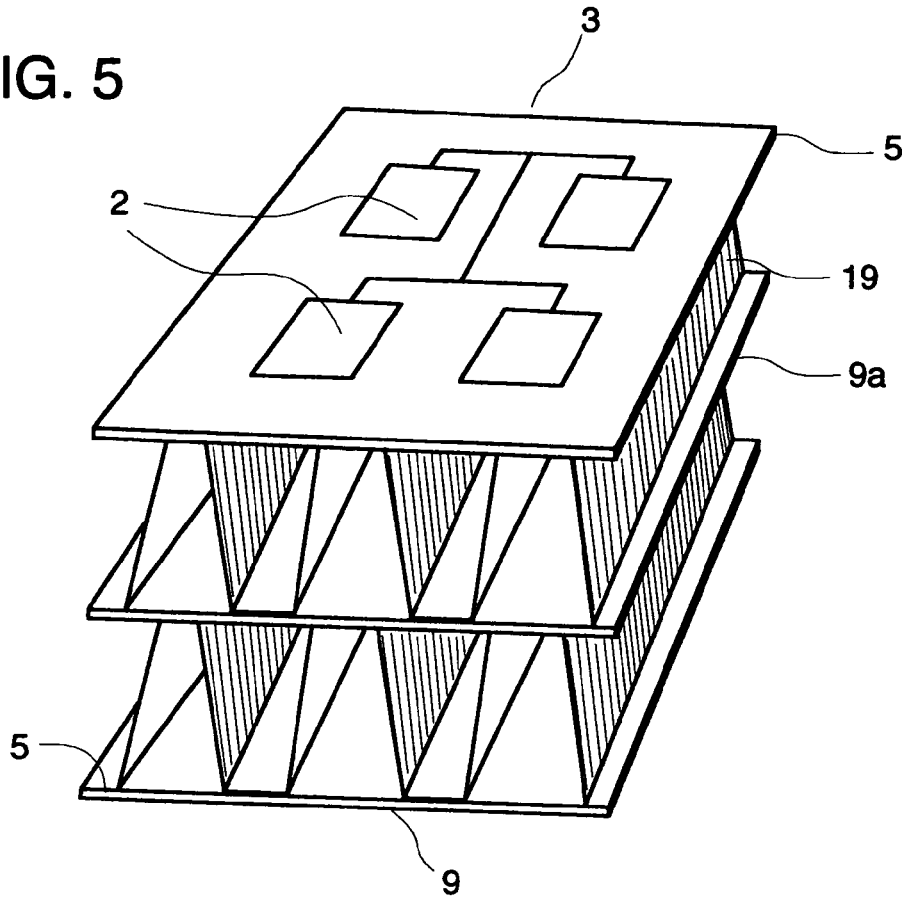
FIG. 5 is diagram of a multilayer stripline antenna constructed with non-woven spacer fabric showing the incorporation of multiple layers of spacer fabric to separate feed lines and antenna patterns.

FIG. 5 is a rendition of a non-woven patch antenna where the microwave patch antennas 2 and feed lines are affixed to the non-woven retainer fabric 5, which is attached to two corrugated non-woven fabric dielectric spacer plates 19, to another non-woven retainer fabric 5 attached to a ground plane 9. This process can be repeated several times to achieve the distance desired between the microwave patches 2 and the ground plane 9.

Figure 6:
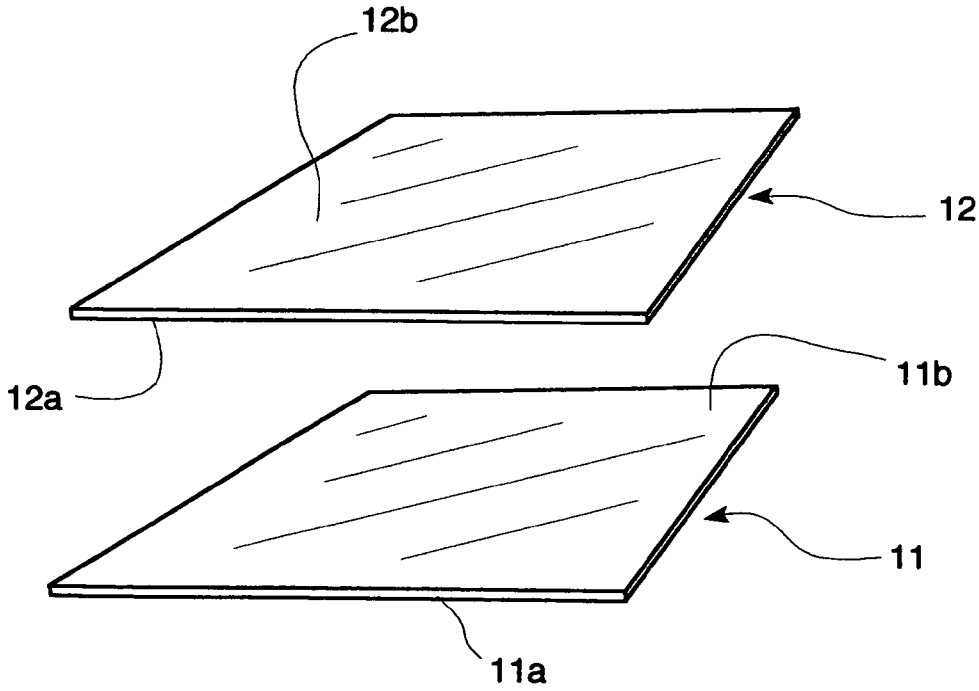
FIG. 6 is a diagram showing the attachment of the conductive fabric to temporary transfer paper.

FIG. 6 depicts a method of fabricating microwave feed lines and antennas by incorporating a conductive fabric such as ShieldEx 151, 11, or other conductive fabric, 11, to an adhesive transfer paper 12. ShieldEx 151 is coated on one side 11A with a thermal setting adhesive during manufacture, allowing it to he attached to another fabric. ShieldEx 151 has a non-adhesive side, 1lb. The attachment is accomplished by applying heat and pressure using a platen press (not shown). The adhesive transfer paper 12 has one side coated with a tack adhesive 12A, and is used for the temporary retention of the non-woven fabric components. Note that the non-adhesive side 11b of the ShieldEx 151 is attached to the temporary adhesive face 12A of the transfer paper.

Figure 7:
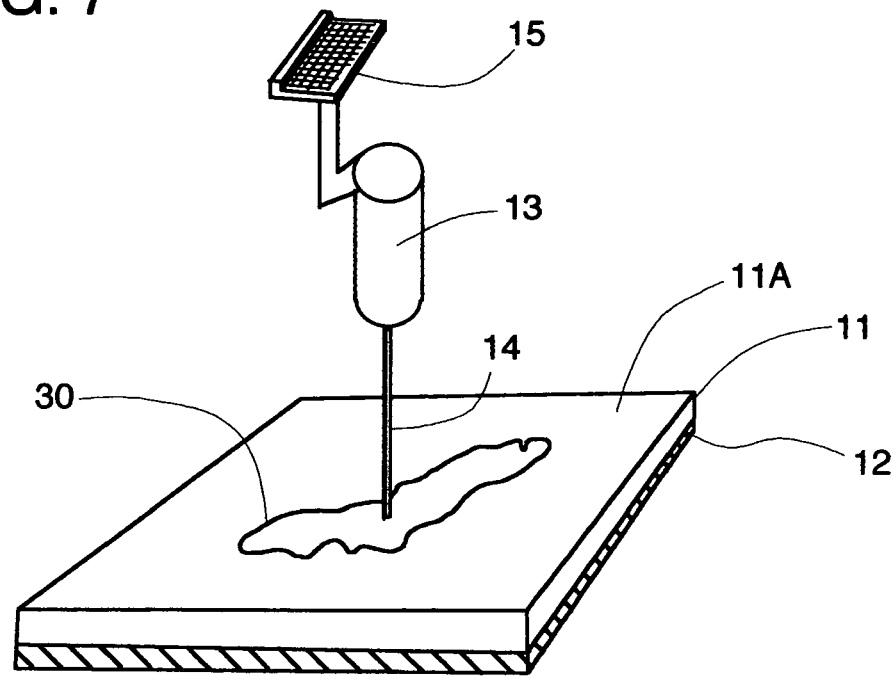
FIG. 7 is a figure showing the cutting of the antenna or feed line pattern from the conductive fabric with the transfer paper attached.

FIG. 7 shows the antenna pattern and/or feedline structure being cut from the conductive fabric 11 attached to the transfer paper 12. The pattern is first digitized according to established art using software programs such as Wilcom or CorelDraw or other programs of equivalent functionality. The digitized pattern is then fed to an automated cutter such as a laser cutter 13. The combined transfer paper 12/conductive fabric material 11 is then fed into the laser cutter 13 with the conductive fabric 11, adhesive side up 11A, exposed to a laser beam 14. The laser beam 14 is adjusted to cut through only the conductive fabric layer 11 leaving the transfer paper 12 intact. The laser cutter 13 is directed under computer control 15 to cut (incise) the boundaries 30 of the closed areas comprising the radiating microwave patch antenna 2 and/or feed patterns 3 through the conductive fabric 11. Thereafter, the conductive fabric 11 and transfer paper 12 are removed from the laser cutter 13 and those areas of conductive cloth not comprising a part of the antenna are removed by hand. The result is a pattern of conductive cloth representing the radiating patch antennas 2 and/or feeds 3 that remain attached to the transfer paper 12.

This next step is not shown. The conductive fabric 11 attached to the transfer paper 12 is then laid down on retainer non-woven fabric 5 such as Avalon 170 or similar non-woven fabric so that the adhesive side of the conductive fabric is next to the retainer fabric. The cloth is then placed in a heat and pressure platen press (not shown) at the cure temperature of the conductive fabric adhesive for a time of 30 to 40 seconds. The heat and pressure attach the adhesive side 11A of the conductive fabric 11 but not the transfer paper 12 to the non-woven carrier fabric 17. The transfer paper 12 is then removed leaving the radiating patch antenna 2 and/or feed pattern 3 attached to the non-woven carrier fabric 17.

Figure 8:
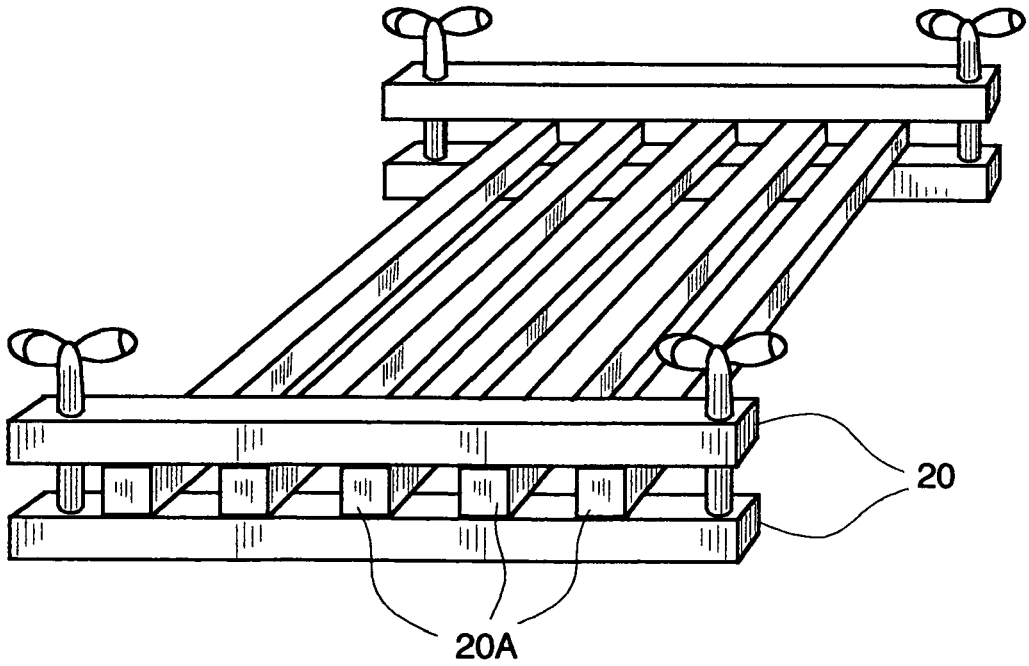
FIG. 8 shows the retention bar and frame structure that is used to hold the non-woven spacer fabric while adhesives are applied.

FIG. 8 depicts a retention bar structure 20 which is used to bond interdigitated (corrugated), molded, non-woven fabric 19 (not shown in this figure) to the retainer non-woven fabric 5. The retainer fabric 5 has been bonded to either the radiating patch antennas 2 and feed lines 3 or to the ground plane 9. The retention arms 20A slide between the folds of the corrugated non-woven spacer fabric 19 to provide support to said spacer fabric 19 for the bonding process. The corrugated non-woven spacer fabric 19 is left in the retention bar structure to bond the retainer non-woven fabric 5 to which either is bonded a ground plane 9 or radiating patch antennas and feedlines 3 are attached. A flat upper press plate 31 (not shown in this figure) together with the retention bar structure 20 sandwich the corrugated non-woven spacer fabric 19 and the retainer non-woven fabric 5 to provide heat and pressure to bond these two pieces together.

Figure 9:
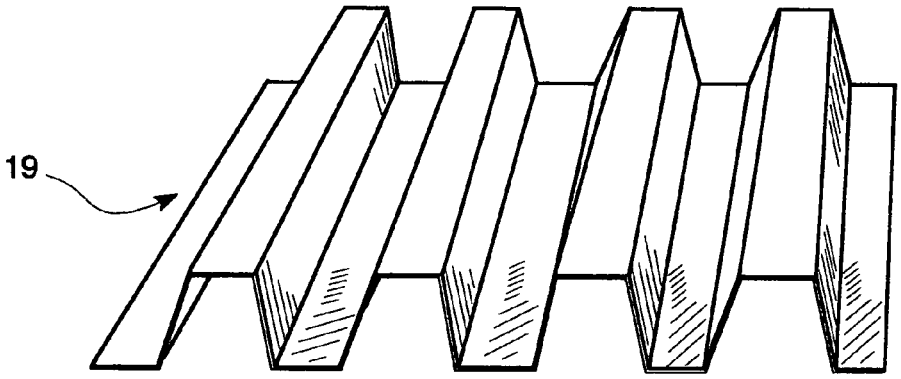
FIG. 9 shows the inter-digitated non-woven fabric in the spacer fabric constniction.

FIG. 9, depicts the corrugated non-woven spacer fabric 19 as it is obtained from the manufacturer. The retention arms 20A are designed to slide easily between the parallel folds to provide support for the heat and pressure of the bonding process. When the bonding process is complete, the retention structure 20 can be removed easily.

Figure 10:
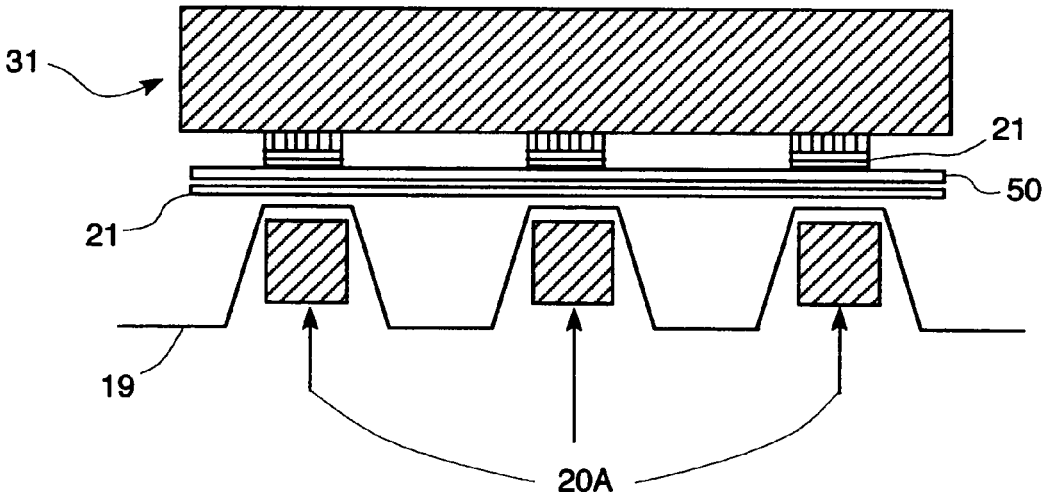
FIG. 10 is a cross sectional view of the apparatus used to apply heat and pressure sensitive film adhesives to attach the antenna and feed layer face fabric to the non-woven spacer fabric.

FIG. 10 depicts bonding the corrugated spacer 19 to the structure formed in FIG. 7 comprising the retainer fabric 5, patch antenna 2, and feed lines 3. In this diagram this retainer fabric/radiating patch antenna/feed line structure is represented as 50 with the exposed retention fabric 5 placed next to the (interdigitated) corrugated non-woven fabric 19. The retention bars 20A serve as a support for the corrugated non-woven spacer fabric 19 which is wrapped over and under the bars. While the corrugated spacer 19 is being supported, retainer fabric/radiating patch antenna/feed line structure 50 is bonded to the flat edges of the corrugated spacer 24.

A film adhesive 21 such as produced by Bemis, is laid between the corrugated non-woven spacer fabric 19 and the non-woven retainer fabric 5 side of the structure 50. The heat and pressure for the bonding/gluing step is provided by the upper portion of the platen press 31, while the retention bars 20A hold the constructed antenna structure and maintain the shape of the (interdigitated) corrugated non-woven spacer fabric 19. The resulting cross section is shown in FIG. 10. Heat of about 350 degrees Fahrenheit for 30 to 45 seconds and pressure of 50-80 psi are used to permanently bond the layers together the non-woven spacer fabric.

Figure 11:
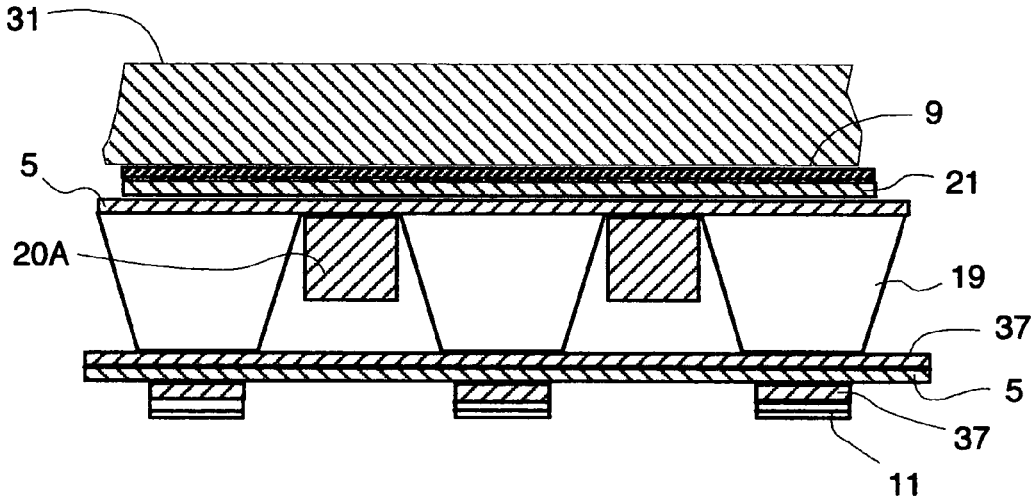
FIG. 11 is a cross sectional view of the apparatus used to attach a subsequent ground plane to the non-woven spacer fabric by means of a heat and pressure sensitive adhesive film.

FIG. 11 depicts the next step in the process where the spacer fabric and antenna face assembly is inverted and the retention bars 20A are inserted through the ends and locked into position in the retention bar structure 20. This assembly is then placed in a thermal pressure platen press (not shown) at 350 degrees Fahrenheit and pressure from 50-80 pounds per square inch for 45 seconds. An adhesive glue 21 placed between the ground plane 9 and the face fabric 5 with the heat and pressure of the platen press causes the structure to bond together. The resulting completed microstrip antenna is then removed from the thermal bonding fixture.

Figure 12:
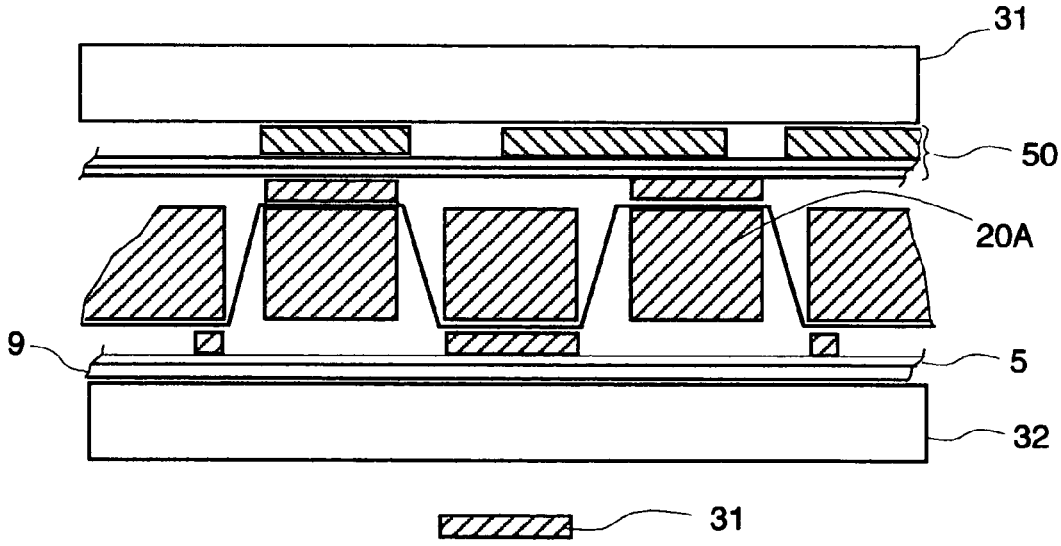
FIG. 12 is a cross sectional view of the combined attachment of a conductive antenna and feed layer face fabric and a conductive ground plane fabric to a common spacer fabric by means of contact cement adhesive.

FIG. 12 represents an alternative embodiment. In this instance, the molded non-woven spacer fabric is arranged between the FIG. 20A of the retention bar structure 20. A layer of thermal setting adhesive 46 is then applied to the molded non-woven fabric opposite the retention bars. The antenna pattern layer comprising the antenna patches 2, feed-lines 3 bonded to retainer non-woven fabric 5 (this structure is designated as 50), and the conductive ground plane fabric 9/retainer non-woven fabric 5 layer (this structure is designated as 90) are then located above and below the retention bar assembly. Upper 31 and lower pressure plate 32 assemblies are applied above and below the face fabric layers. A light pressure, sufficient to hold the assembly in place, is applied until the contact cement cures. When the cure cycle is complete, the pressure plates are withdrawn and the retention bar assembly is also withdrawn leaving the finished microstrip antenna.

Figure 13:
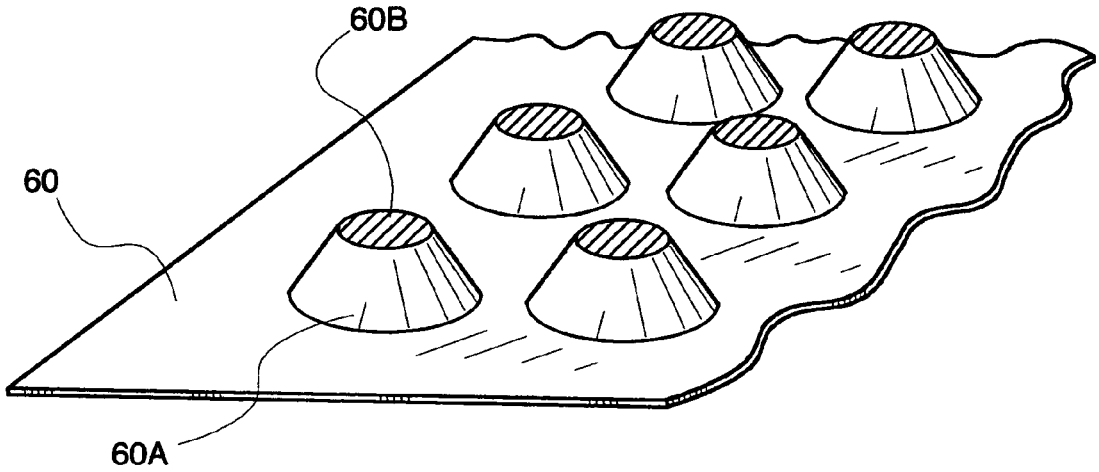
FIG. 13 is a depiction of dimpled nonwoven fabric material and shows the areas to which contact cement may be applied to form an attachment to other layers of said fabric antenna.
Figure 14A:
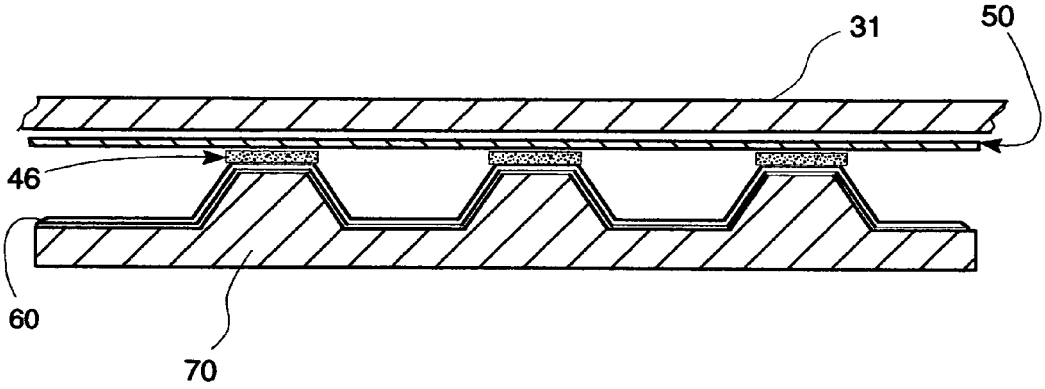
FIG. 14A is a depiction of an antenna can be constructed while the dimpled fabric 60 is still in the lower half 70 of the mold that forms the dimples.

Dimpled non-woven fabric 60 may be used as a dielectric spacer layer. An example of this type of non-woven fabric is depicted in FIG. 13. The apex of each dimple 60B is used to glue a face layer with either patch antennas 2 and feed lines 3 or a ground plane 9. FIG. 14A shows how an antenna can be constructed while the dimpled fabric 60 is still in the lower half 70 of the mold that forms the dimples. Thermal setting adhesive 46 can be applied to the apex of the dimple and the retainer fabric side of a radiating patch antenna/feed line structure 50 can be placed over the apex of the dimple 60B. The bottom of the molded dimple press 70 and a flat platen press plate 31 placed on the top provide heat and pressure to glue the face layer 5 to the dimpled dielectric spacer 60.

Figure 14B:
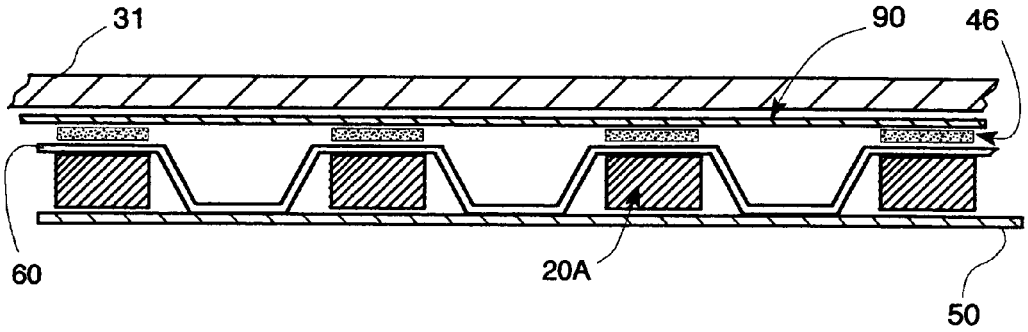
FIG. 14B depicts a second step whereby the base side of the dimpled fabric is attached to the retainer non-woven fabric/radiating antenna/feed line structure or to a retainer non-woven fabric/around plane structure.

FIG. 14B depicts a second step whereby the base side 60A of the dimpled fabric is attached to the retainer non-woven fabric/radiating antenna/feed line structure or to a retainer non-woven fabric/ground plane structure. Retention bars 20A are placed between the parallel rows of dimples to provide support. Thermal setting adhesive 46 is placed on the dimpled non-woven spacer fabric 60 on the side over and opposite the retention bars 20A. The desired retainer fabric structure can then be placed on top of the thermal setting adhesive 46 and the resulting structure can be placed in a platen press (not shown) to provide heat and pressure.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A microwave stripline antenna comprising:

a plurality of conductive antenna patterns;

a plurality of groundplanes;

a plurality of feed elements;

a plurality of feed slots to allow feed elements to pass through the non-woven dielectric spacers; and a plurality of dielectric separator layers comprised of corrugated non-woven fabric as necessary to form a stripline antenna construction.

2. The antenna of claim 1 in which the conductive antenna patterns are comprised of a metalized fabric.

3. The antenna of claim 1 in which the groundplane is comprised of a metalized fabric.

4. The antenna of claim 1 in which said non-woven fabric dielectric spacer is comprised of dimpled non-woven fabric.

5. The antenna of claim 1 in which said corrugated or dimpled non-woven fabric dielectric spacer is interposed between said groundplane layers and said antenna layers.

* * * * *

UNITED STATES PATENT AND TRADEMARK OFFICE

CERTIFICATE OF CORRECTION

PATENT NO. : 7,463,198 B2
APPLICATION NO. : 11/305677
DATED : December 9, 2008
INVENTOR(S) : Michael A. Deaett et al.

It is certified that error appears in the above-identified patent and that said Letters Patent is hereby corrected as shown below:

Col. 1, line 3, insert:

--This invention was made with Government support under DAA00H01-03-C-R200 awarded by DAARPA. The Government has certain rights in the invention.--

Signed and Sealed this
Fifteenth Day of March, 2011

David J. Kappos

David J. Kappos
*Director of the United States Patent and Trademark Office*